US006021782A

United States Patent [19]

Seymour et al.

[11] Patent Number: 6,021,782

[45] Date of Patent: Feb. 8, 2000

[54] METHOD OF AND SYSTEM FOR CIGARETTE TIPPING GLUE SKIP DETECTION AND REJECTION

[75] Inventors: Sydney Keith Seymour, Clemmons; Balager Ademe, Winston-Salem; Gary Lee Wood, Rural Hall; Ford Mitchell Shore, Clemmons, all of N.C.

[73] Assignee: R.J. Reynolds Tobacco Company, Winston-Salem, N.C.

[21] Appl. No.: 08/943,798

[22] Filed: Oct. 3, 1997

[51] Int. Cl.[7] ..... A24C 5/32

[52] U.S. Cl. ..... 131/280; 131/29; 131/35; 131/37; 131/88; 131/90; 131/905; 131/906; 131/907; 131/910; 156/64; 156/358; 156/378; 118/712; 118/672; 118/673

[58] Field of Search ..... 131/29, 35, 37, 131/57.5, 61.1, 71, 76, 88, 90, 93, 95, 280, 284, 905, 906, 907, 910; 156/64, 358, 378; 118/665, 670, 672, 673, 688, 712

[56] References Cited

U.S. PATENT DOCUMENTS

| | | | |
|---|---|---|---|
| 3,190,261 | 6/1965 | Ziffer . | |
| 4,389,969 | 6/1983 | Johnson | 118/665 |
| 4,417,934 | 11/1983 | Vaughan | 156/64 |
| 4,491,490 | 1/1985 | Ehret et al. | 156/64 |
| 4,599,699 | 7/1986 | Stewart-Cox et al. | 131/280 |
| 4,845,374 | 7/1989 | White et al. | 250/560 |
| 5,505,215 | 4/1996 | Bencivenni et al. | 131/905 |
| 5,582,663 | 12/1996 | Matsunaga | 156/64 |
| 5,876,502 | 3/1999 | Sugimura et al. | 118/712 |

FOREIGN PATENT DOCUMENTS

| | | | |
|---|---|---|---|
| 681000 | 10/1952 | United Kingdom | 131/280 |

OTHER PUBLICATIONS

Article entitled "Pre–Checking Filter Attachment" *Tobacco Journal International*, Jun. 1997, cover page and p. 42.

—Operation Manual Excerpt, Burghart, Dec. 1997.

*Primary Examiner*—Stanley S. Silverman
*Assistant Examiner*—Michael P. Colaianni

[57] ABSTRACT

A method of and system for detecting glue skips on tipping paper used to secure filters to cigarette tobacco rods and the rejection of defective cigarettes based thereon in which a particle radiation sensor is used to monitor the amount of glue applied to the tipping paper and a laser edge detector is used to monitor for proper alignment of the tipping paper during cigarette tipping operations in a typical cigarette manufacturing machine. The signals output from the particle radiation sensor are fed to a skip detection system which produces an output signal upon detecting a glue skip or a loss of glue. The glue skip or loss of glue signals as well as the paper edge detection signal produced by the laser edge detector are all fed to a programmable logic controller which, upon detecting a defective condition, generates a cigarette reject signal which is fed to the cigarette rod rejection system of the typical cigarette manufacturing machine in order to prevent the defective cigarettes from entering the stream of commerce.

31 Claims, 5 Drawing Sheets

METHOD OF AND SYSTEM FOR CIGARETTE TIPPING GLUE SKIP DETECTION AND REJECTION

BACKGROUND OF THE INVENTION

The present invention relates to the detection of glue applied to tipping paper used to secure filters to cigarette tobacco rods. More particularly, the present invention is directed to a method of and system for measuring in real time the amount and location of tipping glue coated on tipping paper used with the cigarette tipping portion of a cigarette making machine.

In the manufacturing process for making cigarettes using a typical automatic cigarette making machine which operates at nominal speeds of 8,000 cigarette rods per minute and above, one of the cigarette manufacturing steps involves the application of filter tips to a cigarette rod. As will be known to those of ordinary skill in the art, a cigarette rod of twice the length of the tobacco portion of a cigarette is supplied to the cigarette tipping portion of the cigarette making machine. This double length tobacco rod is cut in half to form cigarette length rods and the two rods are then separated from each other such that a double length filter tip can be placed between the two cigarette length rods. A piece of tipping paper, to which a suitable amount of tipping glue is applied, is caused to wrap around the two tobacco rod double filter assembly, thereby securing the double filter to the end portion of each of the two tobacco rods it contacts. As a last step, the double length filter is cut in half to form two filters, thus yielding two finished cigarettes.

Sometimes however, due to mechanical tolerances and other causes, an insufficient amount of glue is applied to the tipping paper such that, either during manufacture or before or during use of the finished cigarette, the filter separates or falls off from the tobacco rod portion of the cigarette. Investigation has revealed that a substantial percentage of the time the reason that the filter separates from the tobacco rod is that an insufficient amount of glue was applied to the tipping paper so that it did not securely hold the filter to the tobacco rod.

It would therefore be desirable to be able to measure the amount and location of the tipping glue applied to the tipping paper so that any finished cigarette manufactured with an insufficient amount of glue on the tipping paper with which to hold the filter to the cigarette rod can be prevented from leaving the cigarette manufacturing plant. It would also be desirable to be able to reject any such defective cigarettes downstream from the tipping portion of the cigarette making machine when it has been determined that an insufficient amount of glue was applied to the tipping paper. It would likewise be beneficial to utilize as much of the existing cigarette manufacturing machinery as possible to accomplish those goals.

SUMMARY AND OBJECTS OF THE INVENTION

In light of the shortcomings of the prior art in dealing with the detection of glue skips and loss of glue and the resultant falling off or separation of filters from tobacco rods of cigarettes, it is clear there exists a need in the art for a method and system which can be used to accurately monitor the amount and position of glue applied to the tipping paper in the cigarette tipping portion of a typical cigarette making machine in real-time so that cigarettes which are defective by reason of the filter not being properly secured to the tobacco rod be removed from the lot of finished cigarettes and not be packaged and shipped to consumers. It is, therefore, a primary object of the present invention to provide a method of and system for cigarette tipping glue skip detection and rejection such that only finished cigarettes in which the filter is properly secured to the tobacco rod leave the cigarette manufacturing facility.

It is also a primary object of the present invention to provide a method of and system for cigarette tipping glue skip detection and rejection which operates in a simple, accurate and reliable manner.

It is a further object of the present invention to provide a real-time method of and system for detecting glue skips on tipping paper in the cigarette tipping portion of a cigarette making machine and for rejecting finished cigarettes in which the amount of glue applied to the tipping paper is detected to be insufficient to properly secure the filter to the tobacco rod.

It is yet a further object of the present invention to provide a method of and system for cigarette tipping glue skip detection and rejection which monitors different widths of glue skips as well as a loss of glue such that the invention provides an accurate indication of a condition in which an insufficient amount of glue has been applied to the tipping paper which is used to secure a double wide filter to two cigarette rods.

It is still a further object of the present invention to provide a method of and system for cigarette tipping glue skip detection and rejection that can operate at the nominal speeds of typical cigarette manufacturing machinery.

These and other objects of the present invention are accomplished by providing a single particle radiation sensor which monitors the composite glue tipping paper combination and provides a TTL pulse signal proportional to the amount of glue applied to the tipping paper. In addition, a laser edge detector is used to detect the edge of the tipping paper, in order to ensure that the presence of glue measured on the tipping paper has been applied in appropriate locations such that the tipping paper, when wrapped around the double wide filter and two cigarette rods in the tipping portion of a typical cigarette manufacturing machine, will adequately secure that double wide filter to the two tobacco rods. The beta particle and laser edge detectors are mounted adjacent to the composite tipping paper and glue combination in the tipping portion of a typical cigarette making machine.

The voltage signals generated by the digital beta particle detector are supplied to a skip detection system which, using a plurality of filters, determines if there has been a loss of glue or whether a glue skip of different lengths has occurred. Either a loss of glue signal or a glue skip signal having a length consistent with length of the detected glue skip is output by the skip detect computer to a programmable logic controller. The programmable logic controller also receives a signal from the laser edge detector. If the programmable logic controller determines that a glue skip, loss of glue or misalignment of the tipping paper has occurred, it generates a cigarette reject signal which is fed to the existing cigarette rod rejection system of the typical cigarette manufacturing machine with which the instant invention is used. In that manner, cigarettes which have been detected as being defective because of an insufficient amount of glue being properly applied to the tipping paper used to secure the filter to the cigarette tobacco rod are rejected and do not enter the stream of commerce.

DETAILED DESCRIPTION OF THE PREFERRED EMBODIMENT

Figure 1:
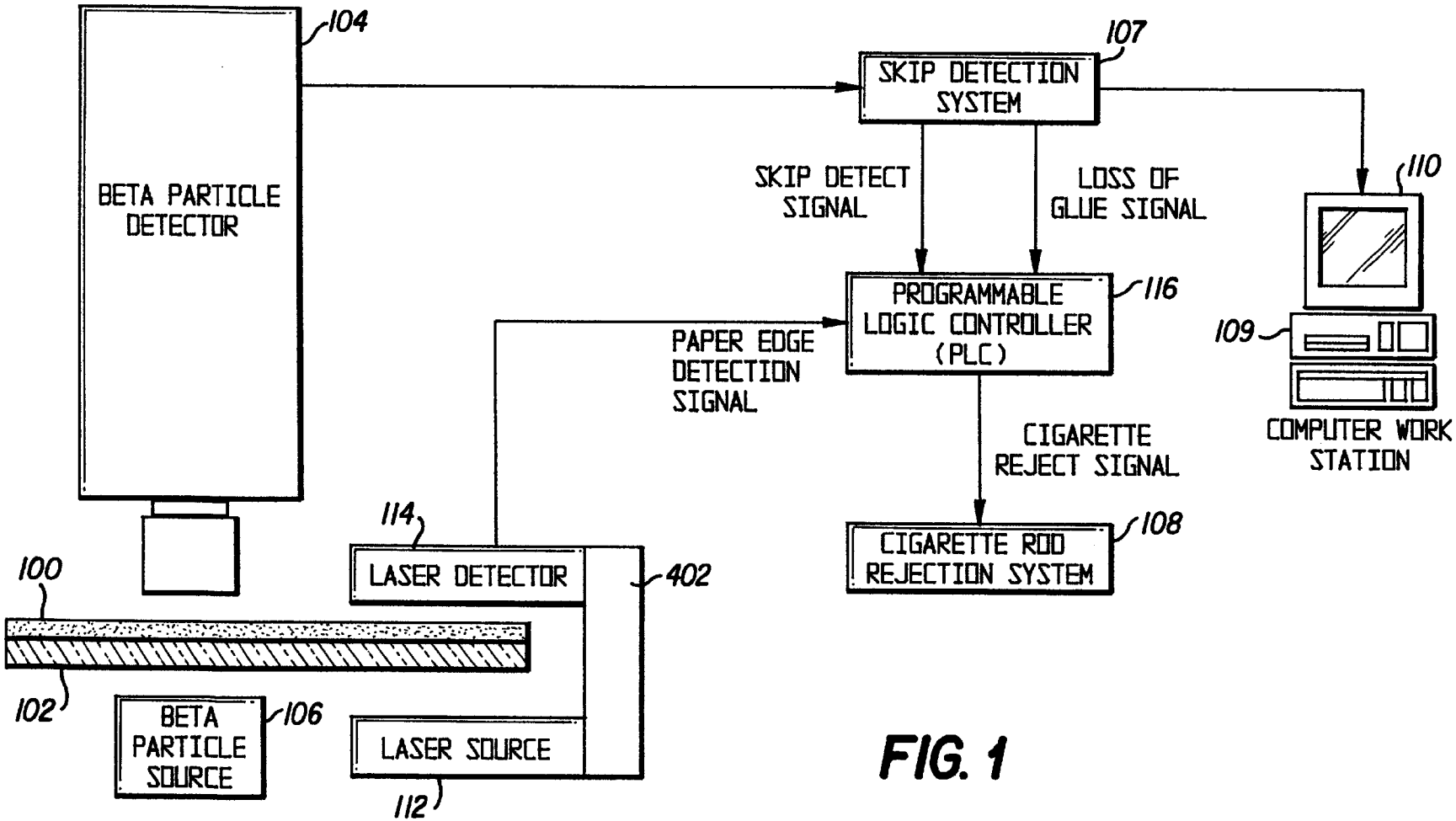
FIG. 1 is a schematic block diagram of the glue skip detection and rejection system of the present invention.

Referring now to the drawings in which like elements are indicated by the same reference numbers, there is shown in FIG. 1 a schematic block diagram of the glue skip detection and rejection system of the present invention. Since 1954, when filters were first used in connection with cigarettes, customers have complained about filters which become detached from or fall off of their cigarette rods. It has been determined that the major reason that the cigarette filters fall off or become partially detached from their cigarette rods is that an inadequate or insufficient amount of glue 100 was placed on the tipping paper 102 or that the glue 100 was not accurately applied to the tipping paper 102. As a result, when the cigarette filter was then attached to the cigarette rod using the tipping paper 102, it was not securely attached.

The glue skip detection and rejection system of the present invention is designed to utilize a beta particle detector 104 which is placed on one side of the glue and tipping paper combination and a beta particle source 106 which is secured on the opposite side. The beta particle detector 104 receives beta particles from the beta particle source 106, which enables the skip detection system 107 to which the output of the beta particle detector 104 is connected, to determine, to a predetermined degree of accuracy, the amount and location of the glue 100 on the tipping paper 102.

As shown in FIG. 1, the beta source 106 is positioned directly beneath the digital beta sensor 104, so that beta particles released by the beta source 106 which pass through the glue 100 tipping paper 102 combination are detected by the digital sensor 104 in a known manner. The digital beta sensor 104 and the beta source 106 are preferably ATI Model 101P, available from ATI of Gaithersburg, Md.

The digital beta particle absorption technology serves to measure the amount of glue 100 applied to the tipping paper 102. The less glue 100 that is present on the tipping paper 102, the fewer beta particles that are absorbed and the more beta particles that reach the beta particle detector 104.

As discussed above, the output voltage signal from the beta particle detector 104 is fed to a skip detection system 107. The skip detection system 107 determines how much glue is present and generates signals accordingly, as will be described hereafter. The skip detection system 107 may preferably be a general purpose personal computer such as an IBM or compatible personal computer using an 80486 or more powerful microprocessor.

The voltage signal available at the input of the skip detection system 107 is a TTL pulse signal proportional to the amount of beta particle radiation which is absorbed by the glue 100 and tipping paper 102 combination, which is itself indicative of the basis weight in grams of the amount of the glue 100 applied to the tipping paper 102. The basis weight and absorbance of the beta particles are related to each other by the formula:

$$\text{Basis Weight} = K_0 + K_1 A + K_2 A^2 + K_3 A^3 \quad (1)$$

where, $$A = -\text{Log}\left[\frac{Readings_{Air} - Readings_{Sample}}{Reading_{Air}}\right] \quad (2)$$

Each sensor is calibrated with a set of, for example, 7 Mylar sheets of known basis weight covering the desired basis weight range. A mathematical model fitting technique is used to compute the coefficients $K_0$, $K_1$, $K_2$ and $K_3$.

The skip detection system 107 runs three digital signal processing (DSP) algorithms simultaneously in order to determine glue skips on the tipping paper 102 based upon the output from the beta particle detector 104. The DSP algorithms or filters detect changes in the output signal from the beta particle detector 104 at a programmable threshold above the noise level. The signal changes occur in the output signal from the beta particle detector 104 when less beta particles are absorbed by the paper and glue combination due to glue skips. Preferably, the three software filters monitor the beta particle detector 104 signal for skips of 15 ms, 30 ms or 60 ms wide patches. If any filter or combination of filters detect a skip, then a skip detect signal is generated based on the longest detected glue skip.

Whenever the skip detection system 107 detects, for example, a 20% increase in beta particle counts from the beta particle detector 104, which corresponds to, for example, a 20% decrease in glue amount for the current cigarettes compared to the previous cigarettes, it generates a loss of glue signal. That signal is processed to reject the bad cigarettes using the cigarette rod rejection system 108 which is built into a typical cigarette making machine to which the glue skip detection and rejection system is interfaced. Optionally, an IBM or compatible personal computer workstation 109 having a display or monitor 110 may be connected to the output of the skip detection system 107 in order to record on a permanent basis the data received and the outputs generated by the skip detection system 107. Alternatively, the skip detection system 107, if it is comprised of a personal computer itself, can functions to permanently record its own operation.

A laser edge detector system 402 is utilized to locate the edge of the tipping paper 102 to ensure that the signals being generated by the beta particle detector 104 correspond to those generated by the presence or absence of the glue 100 on the tipping paper 102. An infrared laser source 112 and a laser detector 114 are located in the cigarette manufacturing machine at one edge of the glue 100 and tipping paper 102 combination and serve to generate a paper edge detection signal, in a known manner.

The paper edge detection signal, as well as the skip detect and loss of glue signals, are all fed to a programmable logic controller 116. The programmable logic controller 116 serves to interface the glue skip detection system of the present invention to the cigarette manufacturing machine, as will be described later herein, and also functions to generate a cigarette reject signal which is fed to the existing cigarette rod rejection system 108 of the cigarette manufacturing machine when it is determined that an insufficient amount of glue 100 was present on the tipping paper 102 such that the filter would not be adequately secured by the tipping paper 102 to the cigarette rod.

Figure 2:
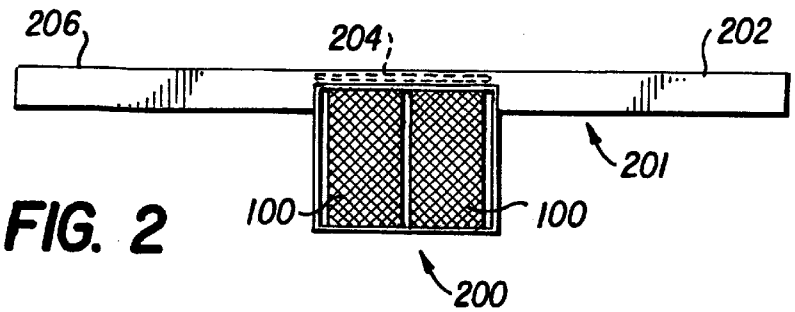
FIG. 2 is a diagram of a top view of a cigarette rod assembly to which tipping paper is being applied.

Referring now to FIG. 2, there is shown a double length cigarette rod 201 which has been cut in half to form two cigarette rods 202 and 206. A double length filter 204 is placed in between the inner ends of the two cigarette rods 202 and 206. In the course of manufacturing cigarettes, the two cigarette rods 202 and 206 are placed in a groove (not shown) on the tipping drum 300 of the tipping portion of the cigarette making machine and the double length filter 204 is placed between their two inside ends. A layer of glue 100 having a length slightly less than the width of the filter 204 is placed on the tipping paper 102. When the tipping paper 102 is wrapped around the two cigarette rods 202, 206 and the filter 204 combination, it serves to secure the two cigarette rods and filter 202–206 together into a single rod assembly. In order to be able to easily cut the double cigarette rod and filter combination 202–206, no glue is placed in the area 200 in the center and at the extreme widths of the tipping paper 102.

Figure 3:
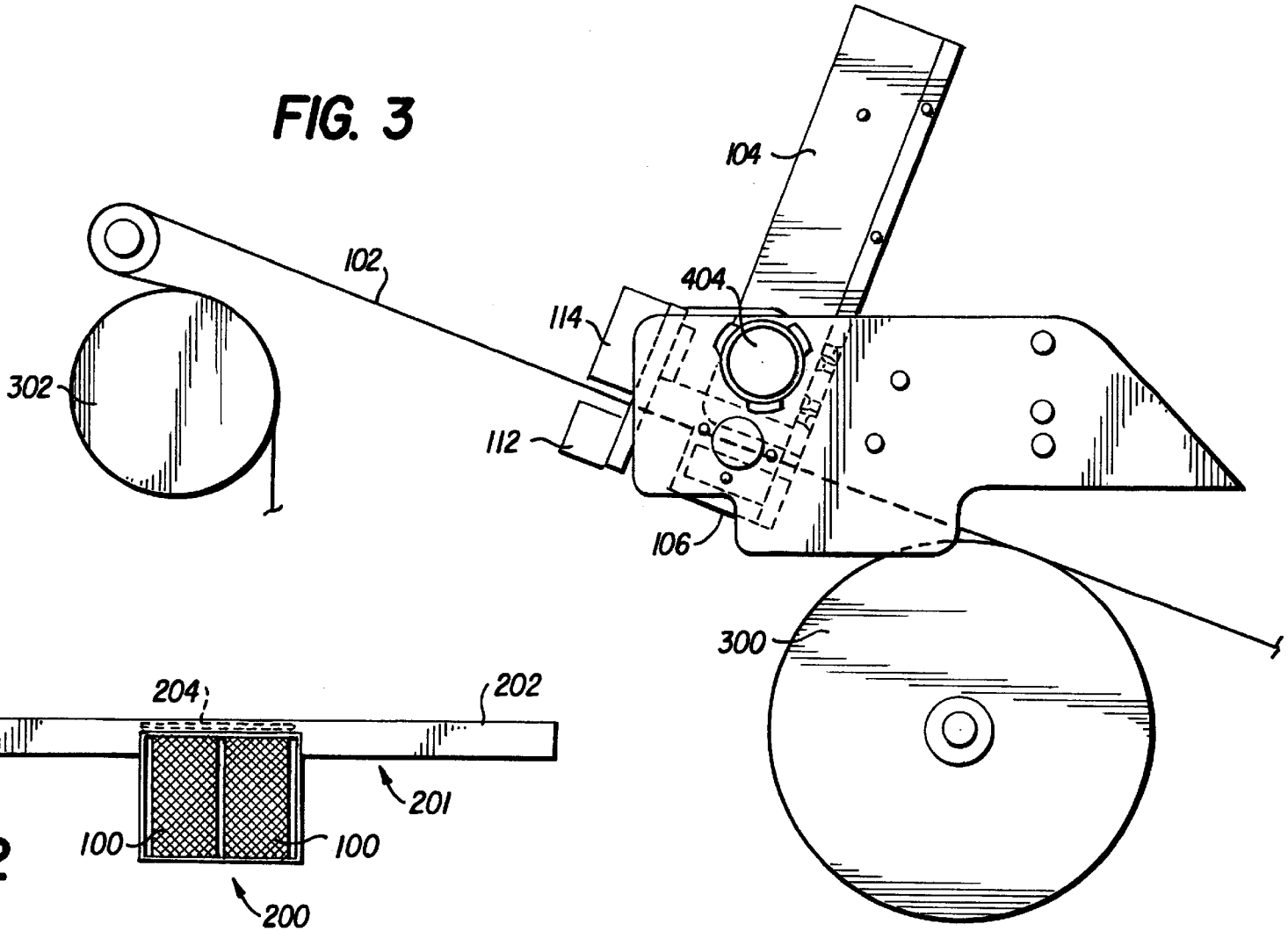
FIG. 3 is a diagram of the side view of the measurement sensors used by the present invention and their locations in a typical cigarette tipping portion of a typical cigarette making machine.

Referring now to FIG. 3, there is shown a diagram of a side view of the laser edge detection system 402 and the beta particle source 106 and detector 104 used by the instant glue skip detection and rejection system mounted to the tipping portion of a typical cigarette manufacturing machine, such as a MAX 80 machine manufactured by Hauni Maschinenbau AG of Hamburg, Germany. As shown in FIG. 3, a glue applicator roller 302 is used to apply glue to one side of the tipping paper 102 before it reaches the laser source 112 of the laser edge detection system 402. After passing by the laser edge detection system 402, the tipping paper 102 with applied glue 100 then passes between the beta particle source 106 and the beta particle detector 104 and over the top of the tipping drum 300. As described before, the conventional tipping drum 300 includes a plurality of grooves which extend around its entire circumference and are used to hold a like plurality of double cigarette rod and filter combinations 202–206. A piece of the tipping paper 102 with the glue 100 applied as also discussed above in connection with FIG. 2 is then cut and wrapped around the double cigarette rod and filter combination 202–206 in a known manner.

Figure 4:
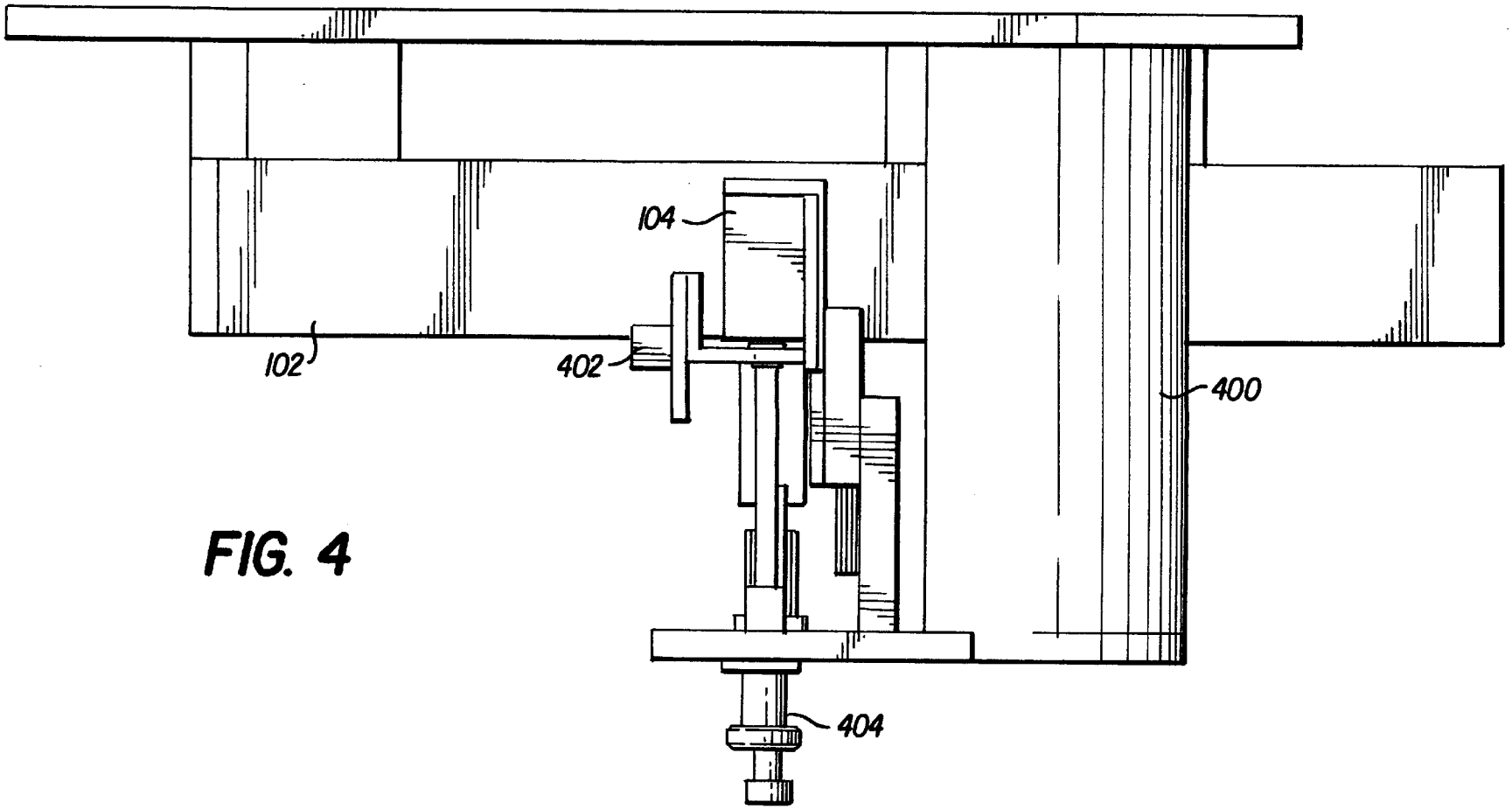
FIG. 4 is a diagram of a top view of the measurement sensors used by the present invention and their locations in a typical cigarette tipping portion of a typical cigarette making machine.

FIG. 4 shows a diagram of a top view of the measurement sensors used by the instant invention and their locations in the cigarette tipping portion of a typical cigarette making machine, as well as the tipping drum housing 400. The laser edge detector 402 which is formed from the laser source 112 and the laser detector 114, may be adjusted by using the positioning handle 404.

Figure 5:
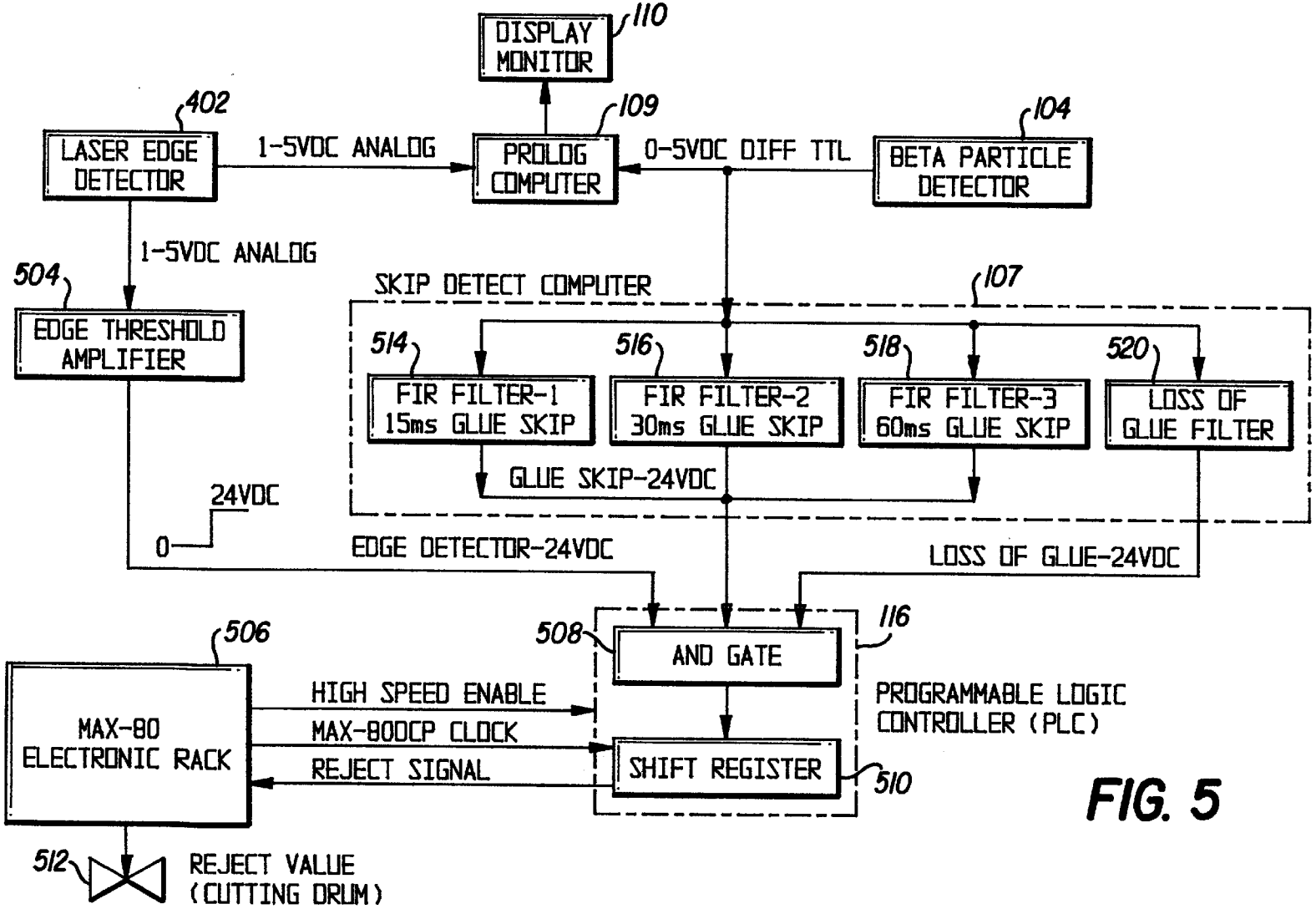
FIG. 5 is a schematic block diagram showing in detail the electronic components which form the glue skip detection and rejection system of the present invention.

FIG. 5 shows a schematic electronic block diagram of the various components which form the glue skip detection and rejection system of the present invention.

As shown in FIG. 5, the analog output from the laser edge detector system 402, as well as the digital output from the beta particle detector 104, are fed to the computer workstation 109 in order to monitor the amount of glue 100 applied to the tipping paper 102 and to compute the results in engineering units, such as grams of glue per square meter. The workstation 109 may preferably be a Pro-Log 486DX Workstation, also available from ATI. However, the rate of data provided to the computer 109, at one sample per 100 ms or seven cigarettes (each tipping paper 102 portion being approximately 15 ms wide per double filter 204) is considerably slower than the skip detection data rate and therefore is primarily used for data archiving and other diagnostic purposes.

The output from the laser edge detector 402, which may be in the range of 1–5 volts DC, is amplified by an edge threshold amplifier 504 to a signal between 0 and 24 volts DC. The thus amplified edge detector signal is fed to one input of the programmable logic controller 116. All of the outputs to the programmable logic controller 116 are fed to an AND gate 508, whose operation will be described hereafter.

In addition to supplying its output to the computer 109, the beta particle detector 104 is also connected to the skip detect computer 107. As previously described, the skip detect computer 107 includes three finite impulse filters 514–518. The output from the beta particle detector 104 is simultaneously fed to the input of each of those filters 514–518. The glue skip detection and rejection system of the present invention is designed to obtain ten readings of each 15 ms width of filter tipping paper 102. Thus, each FIR filter 514–518 is designed to find random glue problems by observing one or more patch widths (15 ms per patch width) of tipping paper 102.

The first FIR filter 514 is designed to check for a glue skip of 15 ms in length. The second FIR filter 516 is designed to detect a 30 ms glue skip, which would correspond to a two patch wide glue skip. In a similar manner, the third FIR filter 518 is designed to detect a 60 ms glue skip, which corresponds to a four patch width glue skip. Each single patch is used to secure the double length filter 204 to form the double rod filter assembly combination 202–206 shown and described in connection with FIG. 2.

Each of the FIR filters 514–518 is preferably optimized for the shape and duration of the defect being detected. In addition, each of the FIR filters is a square matched filter with 170 taps or samples. The aggressiveness of each of the FIR filters 514–518 is set by deciding how many consecutive readings must fall below the threshold value of each respective filter in order to determine if an alarm should be enabled. For example, in the case of the first FIR filter 514 which is designed to detect a single glue skip of 15 ms in length, ten 1.5 ms readings are taken and, if six out of ten consecutive readings fall below the predetermined threshold, the alarm is enabled. Similarly, the double skip or second FIR filter 516 makes ten 3 ms readings and the four glue skip or third FIR filter 518 makes ten 6 ms readings. The second and third glue skip filters 516–518 enable further alarms similar to that described above in connection with the first FIR filter 514, depending on the number of consecutive readings falling below the threshold value.

The threshold value for each of the FIR filters 514–518 is a measure of ten times the sigma of the noise in the output of the beta particle detector 104 (that is, a threshold of 30 means a sigma of 3). Each threshold value is changeable by means of a rotary switch and is used to minimize the number of false rejects generated by the skip detection filters 514–518. In order to further minimize the number of false rejects by the system of the present invention, excessive defects are required to be between at least 170 samples apart for each of the three FIR filters 514–518 so that each of the FIR filters 514–518 may be rearmed with new clean data.

A fourth filter 520 is also included as part of the skip detect computer 107. Its purpose is to examine the raw counts of beta particles which correspond to the output voltage from the beta particle detector 104 and to determine if a total loss of glue has occurred. The glue loss filter 520 constantly monitors for the expected number of beta counts. For example, if the number of counts is 20% more than the expected counts for a predetermined number of patches, such as 200 patches, then a loss of glue signal is produced for a 200 patch time period by the loss of glue filter 520. Since, in the prior art, no sensor system has been provided for use with the cigarette tipping portion of a cigarette making machine to indicate that the machine was not providing sufficient glue to the tipping paper 102, the use of a loss of glue filter 520 is extremely advantageous.

The output from each of the three FIR filters 514–518 is constructed to be an OR output such that the longest filter output signal is turned on for the longest period of time if more than one of the filters 514–518 is producing an output. Thus, for example, if both the 15 ms and 60 ms FIR filters 514 and 518 are producing outputs simultaneously, then the output from the 60 ms FIR filter 518 is supplied as the output of the FIR filter to one input of the AND gate 508 of the PLC 116. The output from each of the FIR filters 514–518 corresponds in time to the 15 ms, 30 ms or 60 ms glue skip period being measured. That is, the length of the output signal from each of the respective FIR filters 514–518 is 15, 30 or 60 ms.

The electronic rack 506 of the MAX 80 cigarette making machine provides a high speed enable to the PLC 116, as well as a clock signal to the shift register 510 which forms part of the PLC 116. The MAX 80 cigarette machine clock signal produces one pulse per dual rod assembly 202–206.

In the PLC 116, the AND gate 508 produces an output signal if any of the three input signals is present. In the event that an output signal is produced by the AND gate 508, it is fed to the PLC 116 shift register 510, which begins counting the number of clock pulses it receives from the MAX 80 electronic rack 506 using the MAX 80 cigarette making machine clock signal, so that it can determine when the double rod assembly 202–206 cigarettes which need to be rejected will reach the cutting drum (not shown) of the cigarette tipping portion of the cigarette making machine. In that manner, the number of pulses which occur between the time the defect in the glue 100 is detected until that double rod reaches the cutting drum is measured.

The shift register 510 then generates a reject signal which causes the reject valve 512 at the cutting drum of the cigarette tipping portion of the cigarette making machine to reject the correct (and defective) double cigarette rod assembly. In that manner, the glue skip detection and rejection system of the present invention is able to detect glue defects in real time in connection with a typical cigarette manufacturing machine which nominally produces 4,000 double rods or 8,000 cigarettes per hour.

Figure 6:
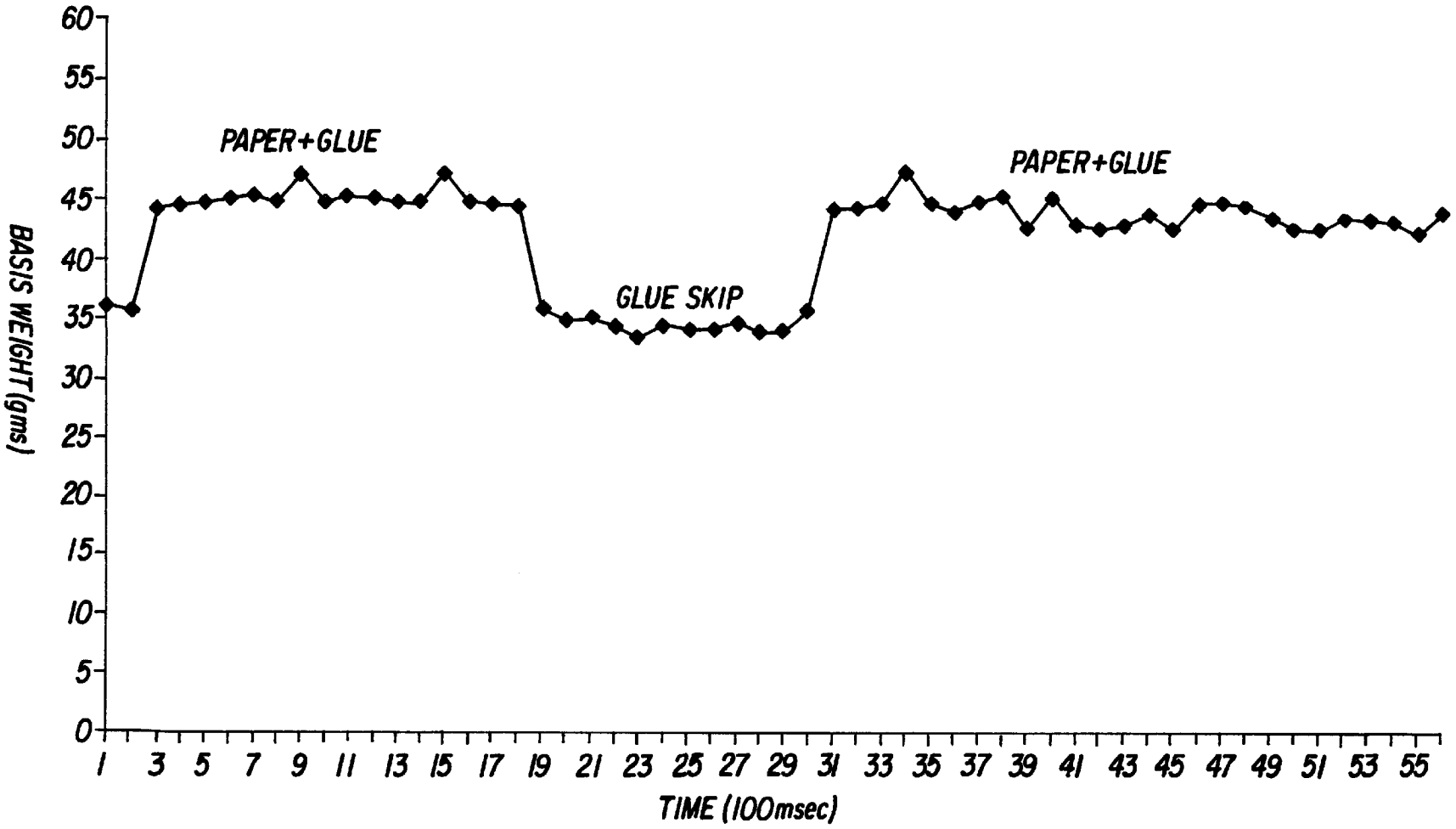
FIG. 6 is a graph generated using data obtained by the present invention, showing the basis weight of the glue and paper versus time and in which a glue skip is shown.

Referring now to FIG. 6, there is shown the results of the operation of the instant glue skip detection and rejection system in basis weight of grams vs. time as measured in 100 ms increments. A glue skip is indicated where the basis weight decreased below, for example, a basis weight of 40 grams.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A method for detecting glue skips during cigarette tipping operations, comprising the steps of:

generating first signals corresponding to the presence of glue on tipping paper used during cigarette tipping operations by measuring the transmissivity of the tipping paper;

analyzing said generated first signals to determine whether a predetermined desired amount of glue is present on said tipping paper; and generating a second signal if it is determined during said analyzing step that said predetermined desired amount of glue is not present on said tipping paper.

2. The method of claim 1, wherein said step of generating a second signal includes at least one of generating a signal indicative of a glue skip and a signal indicative of a loss of glue.

3. The method of claim 1, further including the steps of receiving said second signal and generating a cigarette rod rejection signal based thereon.

4. The method of claim 1, wherein said step of analyzing includes determining whether a glue skip has occurred on said tipping paper.

5. The method of claim 4, wherein said determining step includes determining if said glue skip has occurred for different lengths on said tipping paper.

6. The method of claim 3, further including the step of interfacing said cigarette rod rejection signal to a cigarette manufacturing machine in real time in order to reject cigarette rods determined to be defective.

7. The method of claim 1, further including the step of monitoring said tipping paper in order to determine whether an edge of said tipping paper is properly aligned during said tipping operations.

8. The method of claim 7, further including the step of generating a third signal when said tipping paper is not properly aligned.

9. The method of claim 3, further including the steps of generating a third signal when said tipping paper is not properly aligned during said tipping operations.

10. The method of claim 9, further including the steps of receiving said third signal and generating said cigarette rod rejection signal based upon receipt of one of said second and third signals.

11. The method of claim 10, further including the step of interfacing said cigarette rod rejection signal to a cigarette manufacturing machine in real time in order to reject cigarette rods determined to be defective.

12. A system for detecting glue skips during cigarette tipping operations, comprising:

means for generating first signals corresponding to the presence of glue on tipping paper used during cigarette tipping operations by measuring the transmissivity of the tipping paper;

means for analyzing said generated first signals to determine whether a predetermined desired amount of glue is present on said tipping paper; and means for generating a second signal if it is determined during said analyzing step that said predetermined desired amount of glue is not present on said tipping paper.

13. The system of claim 12, wherein said means for generating a second signal includes at least one of means for generating a signal indicative of a glue skip and a signal indicative of a loss of glue.

14. The system of claim 12, further including means for receiving said second signal and generating a cigarette rod rejection signal based thereon.

15. The system of claim 12, wherein said means for analyzing includes means for determining whether a glue skip has occurred on said tipping paper.

16. The system of claim 12, wherein said means for analyzing includes means for determining whether a glue skip has occurred for different lengths on said tipping paper.

17. The method of claim 14, further including means for interfacing said cigarette rod rejection signal to a cigarette manufacturing machine in real time in order to reject cigarette rods determined to be defective.

18. The system of claim 12, further including means for monitoring said tipping paper in order to determine whether an edge of said tipping paper is properly aligned during said tipping operations.

19. The system of claim 18, further including means for generating a third signal when said tipping paper is not properly aligned.

20. The system of claim 14, further including means for generating a third signal when said tipping paper is not properly aligned during said tipping operations.

21. The system of claim 20, further including means for receiving said third signal and generating said cigarette rod rejection signal based upon receipt of one of said second and third signals.

22. The system of claim 21, further including means for interfacing said cigarette rod rejection signal to a cigarette manufacturing machine in real time in order to reject cigarette rods determined to be defective.

23. A system that detects glue skips during cigarette tipping operations, the system comprising:

a source positioned on a first side of a tipping paper;

a detector positioned on a second side of the tipping paper, wherein the detector generates a signal that indicates the transmissivity of the tipping paper; and a skip detector in communication with the detector to receive the signal, the skip detector being responsive to a signal that indicates that a desired amount of glue is not present on the tipping paper to generate a loss of glue signal.

24. The system of claim 23, wherein the skip detector comprises at least one finite impulse filter and is further responsive to a signal of at least one predetermined length to generate a loss of glue signal that is a glue skip signal.

25. The system of claim 24, wherein the predetermined lengths include at least one of a 15 ms, a 30 ms and a 60 ms.

26. The system of claim 23, wherein the skip detector comprises a glue loss filter.

27. The system of claim 23, further comprising a cigarette rod rejection system that is responsive to the loss of glue signal to reject a cigarette rod corresponding to the loss of glue signal.

28. The system of claim 27, wherein the cigarette rod rejection system is a programmable logic controller.

29. The system of claim 28, wherein the programmable logic controller comprises:

an AND gate; and a shift register.

30. The system of claim 23, further comprising an edge detector that generates a paper edge detection signal.

31. The system of claim 30, wherein the edge detector comprises:

a laser edge detector; and an edge threshold amplifier in communication with the laser edge detector.

* * * * *